US006336599B1

(12) United States Patent
Herr et al.

(10) Patent No.: US 6,336,599 B1
(45) Date of Patent: Jan. 8, 2002

(54) SPRINKLER SPRAY SHIELD

(76) Inventors: Randall M. Herr, 12 Bella Caserta, Lake Elsinore, CA (US) 92532; Anthony D. Herrera, 24951 1st. Ave., Murrieta, CA (US) 92564

( * ) Notice: Subject to any disclaimer, the term of this patent is extended or adjusted under 35 U.S.C. 154(b) by 0 days.

(21) Appl. No.: 09/617,019

(22) Filed: Jul. 14, 2000

(51) Int. Cl.[7] ..... B05B 1/26

(52) U.S. Cl. ..... 239/522; 239/518; 239/505; 239/511; 239/513; 248/156

(58) Field of Search ..... 239/104, 273, 239/275, 276, 288, 288.5, 461, 505, 507, 510, 511, 512, 513, 514, 515, 518, 522, 201, 203, 288.3; 248/156, 274.1, 415, 284.1, 125.7, 533

(56) References Cited

U.S. PATENT DOCUMENTS 877,785 A * 1/1908 Linhoff ..... 239/513 X
1,058,189 A * 4/1913 McBoyle ..... 239/511 X
1,502,822 A * 7/1924 Hill ..... 239/513
1,521,863 A * 1/1925 Brockschmidt ..... 239/522 X
2,298,765 A * 10/1942 Johnson ..... 239/511
2,329,231 A * 9/1943 Thomas ..... 239/511 X
2,480,989 A * 9/1949 Weaver ..... 239/513
3,009,652 A 11/1961 McKay
4,461,423 A 7/1984 Davis
5,039,015 A 8/1991 De La Vega, Jr.

* cited by examiner

*Primary Examiner*—Steven J. Ganey
(74) *Attorney, Agent, or Firm*—Edgar W. Averill, Jr.

(57) ABSTRACT

A spray shield apparatus for shielding against spray from a sprinkler. The spray shield apparatus has an elongated support rod capable of being anchored relative to the sprinkler. A pair of baffles are mounted to an upper shank of the support rod with least one baffle having a pivot end which pivots to different angles relative to the other baffle. Additionally, flexible tabs which extend from the upper shank are preferably used to releaseably secure the pivoting baffle(s) at the desired angle. The flexible tabs are capable of engaging and disengaging notched grooves located on an inner surface of the pivot end.

6 Claims, 2 Drawing Sheets

SPRINKLER SPRAY SHIELD

BACKGROUND OF THE INVENTION

The field of the invention pertains to sprinklers and sprinkler spray shields. The invention relates more particularly to a spray shield apparatus having a pair of independently adjustable baffles which may be variably angled relative to each other to optimally deflect spray emitted from a sprinkler.

Sprinklers and sprinkler systems have commonly been used to irrigate agricultural tracts as well as household lawns and gardens. Generally, sprinklers are the exposed components of an underground network of water pipes, and widely spaced to effectively reach the entirety of a target area. Unfortunately, however, sprinklers are oftentimes positioned adjacent a curb, driveway, walkway, building, fence, or other structure or location where it is not desirable to have water sprayed. Furthermore, when adjusting or otherwise attending to an active sprinkler, the spray may wet or otherwise interfere in the work of the attending individual.

Various spray shields or deflectors have been developed in an effort to confine and/or redirect water spray to a target area, as well as to shield a structure, location, or person from undesired water spray. One example of a sprinkler shield is shown in U.S. Pat. No. 3,009,652 having a single plate slidably and rotatably affixed to a sleeve. A set screw adjustably secures the sleeve to an upper portion of a post, and the post is adjustably mounted on the lower portion of a sprinkler pipe by a pair of collars using set screws.

And in U.S. Pat. No. 4,461,423, an arc-shaped splash shield is shown mounted at the top of a support rod and partially surrounding a sprinkler. The support rod has a hook at the bottom of the support rod which engages and clamps to a sprinkler pipe when the upper end of the support rod is drawn away from the sprinkler pipe.

Finally, in U.S. Pat. No. 5,039,015, a hand held splash shield is disclosed having a rigid polymeric rectangular sheet is with a mesh screen housing. The mesh screen housing operates to diffuse water spray emitted from a sprinkler head when positioned adjacent a sprinkler head.

Perhaps the greatest deficiency common to all of the aforementioned patents is the use of a single shield or baffle piece. In both the '625 and '015 patents, a single shield piece having a planar configuration is disclosed. While the single plane configuration effectively operates to confine spray to one side of the shield, i.e. encompassing a 180 degree spray range, it prevents angular adjustment of the spray range to optimally suit a variety of areas and applications. In particular, the prior art single plane shields/baffles would be unable operate efficiently, i.e. limit spray to a target area, when positioned at a corner location of a lawn or garden. And while the '423 patent discloses an arc-shaped shield piece which encompasses an angular spray range of less than 180 degrees, the rigid, one-piece splash shield precludes angular adjustment of the spray range.

Furthermore, the manner of adjustably rotating and securing the shield/baffle at various deflection angles in the '652 and '423 patents may be inadequate for performing simple, quick angle adjustments. In particular, the sprinkler attachment disclosed in the '652 patent adjustably rotates and secures the baffle component by releasing and resetting a set-screw mounted on a sleeve which supports the baffle. The clamps used in the '652 patent also use set-screws to adjustably secure mounting collars to the sprinkler pipe. The use of set-screws, however, while functioning to securely maintain a desired position, may be difficult and arduous to release and reset for many users, especially when the set-screw begins to rust or corrode. For the '423 patent, because the arc-shaped shield/baffle is secured to the top of the support rod, rotatably adjusting the arc-shaped shield to a desired deflection angle requires that the entire sprinkler shield unit, including the support rod and brace, must be lifted and rotated and the brace reset on the sprinkler.

Thus, while the devices disclosed in the '652, '423, and '015 patents serve to generally shield against unwanted spray from a water sprinkler, the inherent structural designs function to limit the shielding operation, which consequently also limits their utility in a wide range of uses and applications.

BRIEF SUMMARY OF THE INVENTION

It is an object of the present invention to provide a simple, durable, and cost-effective spray shield apparatus having two shield portions capable of adjusting the shield angle therebetween, for optimally containing and/or redirecting water spray to a target area, and preventing water spray from reaching a protected structure, person or area.

It is a further object of the present invention to provide a simple, durable, and cost-effective spray shield apparatus having an adjustable locking mechanism for adjustably setting the relative angle between the two shield portions at desired shield angles, without many moving parts.

The present invention is for a sprinkler shield apparatus for shielding against spray from a sprinkler. The sprinkler shield apparatus has an elongated support rod with an upper shank and a lower shank. The lower shank is capable of anchoring the elongated support rod relative to the sprinkler. Additionally, the sprinkler shield apparatus has a pair of baffles with mounting ends connected to the upper shank of the elongated support rod. At least one of the mounting ends is a pivot end which is adapted to pivot about the upper shank. This enables the pair of baffles to achieve various desired baffle angles between each other. The sprinkler shield apparatus also has means for adjustably securing the pair of baffles relative to each other at the various desired baffle angles.

DETAILED DESCRIPTION OF THE PREFERRED EMBODIMENTS

Figures 2, 3, 4, 5, 6:
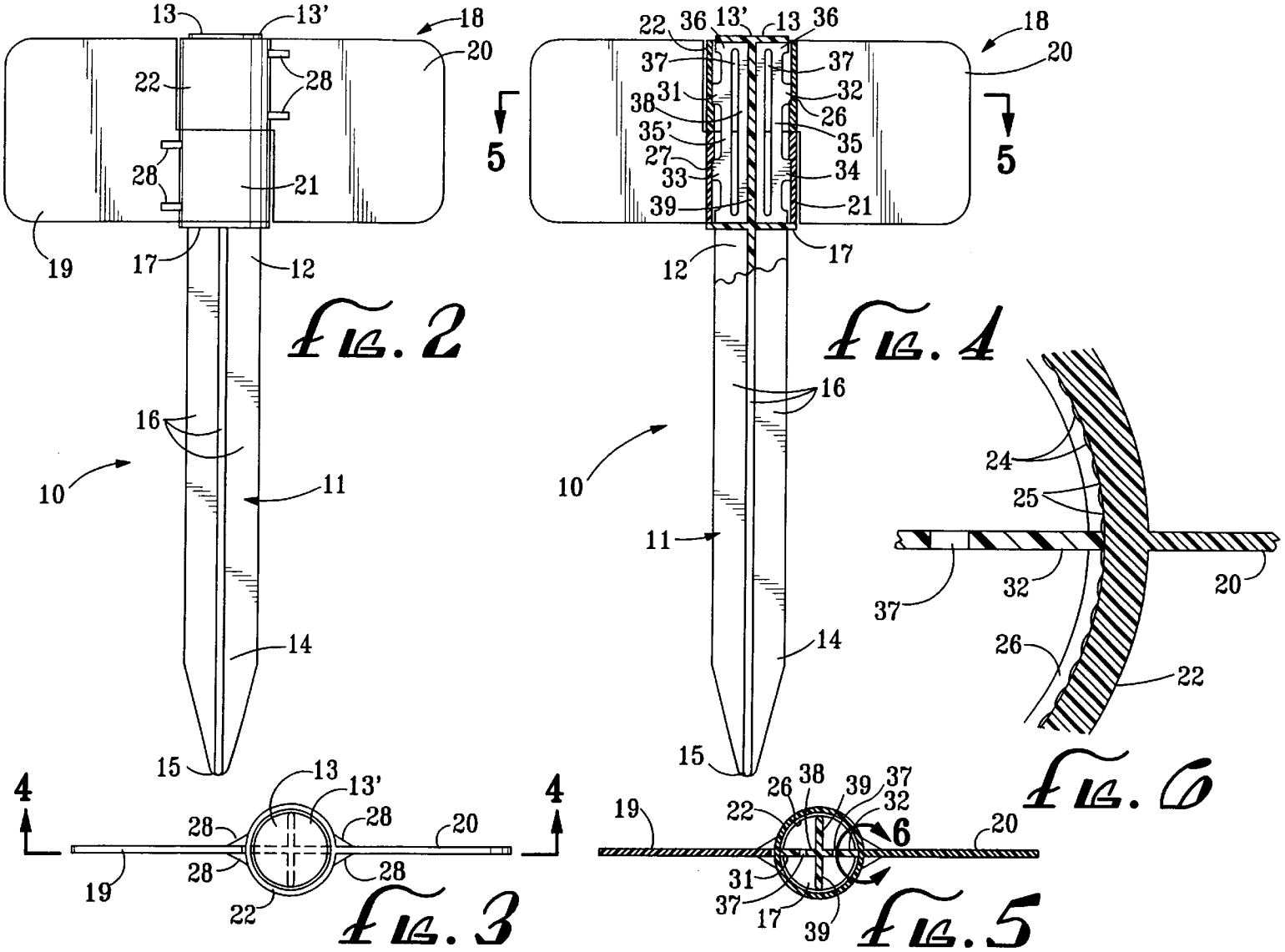
FIG. 2 is a front elevational view of the spray shield it apparatus of FIG. 1.
FIG. 3 is a top view of the spray shield apparatus of FIG. 2.
FIG. 4 is a partly cross-sectional view of the spray shield apparatus taken along the line 4—4 of FIG. 3, showing in detail the means for adjustably securing the baffles to the elongated support rod.
FIG. 5 is a cross-sectional view of the spray shield apparatus taken along the line 5—5 of FIG. 4.
FIG. 6 is an enlarged view of the means for adjustably securing, taken along the circle 6 of FIG. 5.

Referring now to the drawings, FIGS. 2 and 4 best show the spray shield apparatus, generally indicated at reference character 10. The spray shield apparatus 10 generally comprises an elongated support rod, generally indicated at reference character 11, and a baffle assembly, generally indicated at reference character 18. Both the elongated support rod 11 and the baffle assembly 18 may be constructed of a suitable plastic material, such as polyethylene, which can be easily formed by conventional manufacturing and production methods.

Figure 8:
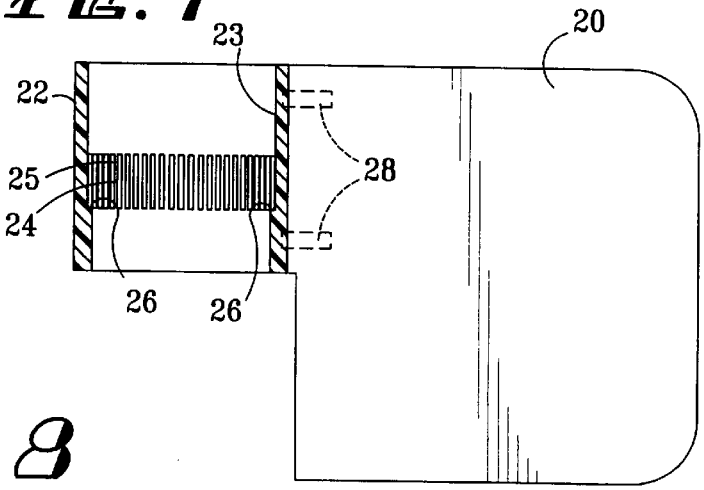
FIG. 8 is a perspective view of the elongated support rod absent the baffle assembly.

Details of the support rod 11 can be best seen in FIGS. 3, 4, and 8. The support rod 11 has an upper shank 12 upon which the baffle assembly 18 is mounted, and a lower shank 14 which is capable of anchoring the support rod 11 relative to an adjacent water sprinkler (40 in FIG. 1). The lower shank 14 of the elongated support 11 may be anchored directly to the sprinkler by suitable rod anchoring means (not shown). In the alternative, the lower shank 14 may be designed as a stake that is driven and anchored into the ground adjacent the sprinkler. For purposes of anchoring to the ground, the elongated support rod 11 preferably has a tapered leading end 15 and a cross-shaped cross-section formed by intersecting ribs 16. The ribs 16 help displace earth out of the way as the support rod 11 is being driven into the ground. And the upper shank 12 of the elongated support rod 11 is adapted to receive and support the baffle assembly 18 thereon. Preferably, and in particular, the upper shank 12 also has a cross-shaped cross-section similar to the lower shank 14, as can be best seen in FIGS. 4 and 8, which will be discussed in detail below in regards to mounting of the baffle assembly 18.

In a first preferred embodiment, the baffle assembly 18 comprises two baffle components 19, 20 mounted to the upper shank 12 of the elongated support rod 11. As shown best in FIGS. 2, 4, and 7, each baffle component 19, 20 has a plane configuration which functions as a shield to block and/or deflect water spray emitted from a water sprinkler with its relatively large area (see FIG. 1). And as can be seen in the top and cross-sectional views of FIGS. 3 and 5, respectively, the baffle components 19, 20 have a relatively thin-walled construction. It is notable that the length of each baffle 19, 20 extending radially from the upper shank 12 is sufficiently long to narrow the angular range of the water spray trajectory (44 in FIG. 1). Each baffle 19, 20 has a mounting end 21, 22, respectively, which connects to the upper shank 12 of the elongated support rod 11. At least one of the two mounting ends 21, 22 is a pivot end adapted to pivot about the upper shank 12. Preferably, both mounting ends 21, 22 are pivot ends 21, 22 capable of independently pivoting relative to each other. It is contemplated, however, that other embodiments of the baffle assembly 18 may incorporate only one pivot end, with the other mounting end affixed and stationary relative to the upper shank 12.

As can be best seen in FIGS. 3 and 5, the pivot ends 21, 22 have a tubular configuration which functions as a collar to telescopically mount to the upper shank 12. As shown in FIGS. 2 and 4, the pivot ends 21, 22 are serially mounted adjacent each other along the upper shank 12, with the upper pivot end 21 near the top end 13 of the upper shank 12. Each baffle component 19, 20 extends adjacent the pivot end 22, 21, of the other baffle component 20, 19 while maintaining a marginally spaced distance, to form a relatively continuous shield wall. Additionally, support flanges 28 provide supplemental support of the baffle components 19, 20 against the pivot ends 21, 22.

Figure 7:
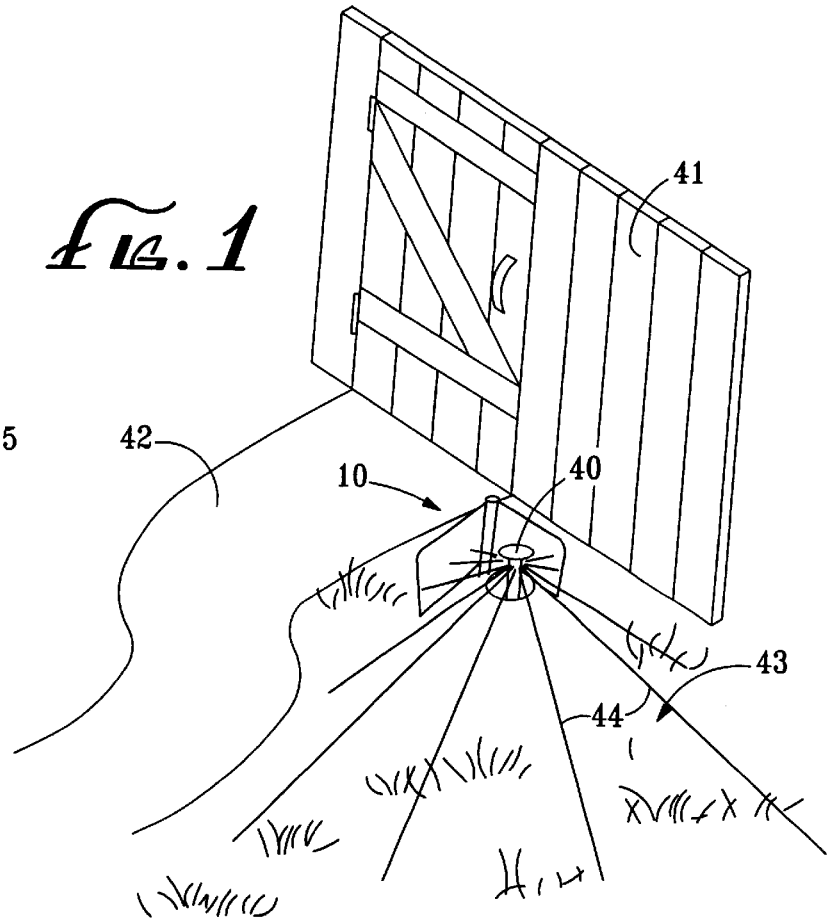
FIG. 7 is a partly cross-sectional view of a single baffle, showing in detail the notch grooves and ridges inside the mounting end.

As shown in FIGS. 6 and 7, the tubular configuration of the pivot ends 21, 22 has an inner tube surface 23 with a plurality of notched grooves 25. The plurality of notched grooves extend parallel to a longitudinal central axis of the tube-shaped pivot end 21, 22, and encircle the circumference of the inner tube surface 23. The notched grooves 25 are relatively shallow whereby a tab piece (see discussion below) may be easily transitioned from one notched grooved to another, while maintaining engagement when struck by water spray. As can be best seen in FIG. 6, each of the tabs 31–34 will preferably engage a single notched groove at a time. Furthermore, the inner surface 23 of the tubular configuration has a transverse deck 26 which preferably has a ring-shaped configuration encircling the inner surface 23. The transverse deck 26 functions to retain the mounting ends 21, 22 to the upper shank 12 of the elongated support rod 11.

The spray shield apparatus 10 finally includes means for adjustably securing the baffles 19, 20 to the upper shank 12 of the elongated support rod 11. The means for adjustably securing is preferably at least two tabs 31, 32, (also 33, 34) connected to the upper shank 12 of the elongated support rod 11. Preferably, where both mounting ends are pivot ends 21, 22 as shown in the present figures, four tabs 31–34 are provided: tabs 31 and 32 for adjustably securing the upper pivot end 22, and tabs 33 and 34 for adjustably securing the lower pivot end 21. And preferably still, the tabs 31–34 are positioned at opposite ends of the upper shank 12, in order to provide balanced engagement of the tabs 31–34 with the notched grooves 25.

Each of the tabs 31–34 have resiliently biasing means for engaging and disengaging at least one of the plurality of notched grooves 25. As shown in the figures, a preferred embodiment of the resiliently biasing means is a bridge (35, 35') having a leaf-spring configuration. Two bridges 35, 35' are shown in FIGS. 4, 5, and 8, each supported by opposite bridge ends 36, which connect to a hub portion 38 of the upper shank 12. Consequently, a bridge gap 37 is formed between the bridges 35, 35' and the hub portion 38. At least one tab is suitably connected to each bridge 35, 35' such that the at least one tab engages with at least one notched groove of the at least one pivot end of the pivoting baffle. And as can be seen in FIGS. 4 and 8, each bridge 35, 35' preferably has two tabs (32, 34 and 31, 33, respectively), the upper tabs 31, 32 engaging the upper pivot end 22, and the lower tabs 33, 34 engaging the lower pivot end 21. Furthermore, as can be seen in FIGS. 4, 5, and 8, the upper shank 12 additionally has at least one, and preferably two, radial support portions 39 which are interposed between the at least two tabs (31, 32, and 33, 34). The radial support portions 39 have a support tip which is proximately positioned to the plurality of notched grooves 25 without engaging the plurality of notched grooves 25.

The result is a simple and easy-to-use sprinkler spray shield apparatus 10 which may be easily installed and operated by individuals with little or no mechanical experience and without the use of special tools. When the baffles 19, 20 are rotated to achieve different deflection angles, the resiliently biasing action of the length of the bridge 35 tends to resiliently flex. This consequently enables the tabs 31–34 to overcome the ridges 24 formed between the notched grooves 25 when transitioning from one notched groove to the next. It is notable that while the bridges 35, 35' ideally remain unbiased when the tab is positioned in the at least one notched groove 25, some degree of flexion and bending may exist, which functions to produce sufficient force to maintain contacting engagement between the tabs and the selected notched groove 25. In any case, however, a greater degree of resilient biasing occurs during transition of the tabs 31–34 between notched grooves, such that the tabs 31–34 maintain contact with the inner surface 23 of the tubular configuration at all times. Additionally, the radial support grooves 39 provide radial support when the pivot ends 21, 22 are rotated between various baffle angles.

Figure 1:
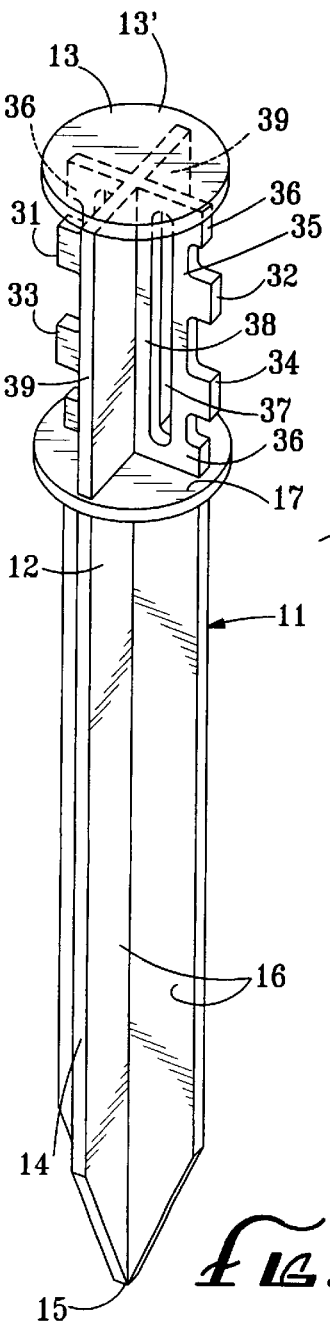
FIG. 1 is a perspective view of the spray shield apparatus as it is employed against a water sprinkler located near a fence and walkway.

In this manner, and as shown in FIG. 1, the spray shield apparatus 10 may be positioned adjacent a water sprinkler 40, and in particular, behind the spray opening of the water sprinkler. In this position, the shield apparatus 10 can effectively keep spray from reaching protected areas near the sprinkler, such as a walkway 42 and a fence 41, and confining the water spray trajectory 44 to a target area, such as a lawn 43. The spray shield apparatus 10 may be utilized in conjunction with both intermittent and non-intermittent water sprinklers.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A spray shield apparatus for shielding against spray from a sprinkler, said spray shield apparatus comprising:

an elongated support rod having an upper shank, and a lower shank capable of anchoring said elongated support rod relative to said sprinkler;

at least one baffle having a pivot end with a tubular configuration, said at least one baffle telescopically and pivotally mounted on said upper shank to pivot about the upper shank to various desired positions; and means for adjustably securing said at least one baffle to said various desired positions, said means for adjustably securing comprising:

a plurality of notched grooves along an inner tube surface of the tubular configuration of said pivot end; and at least two tabs connected to the upper shank of said elongated support rod, each tab adapted to engage at least one of said plurality of notched grooves, and each tab having resiliently biasing means for engaging and disengaging said at least one of said plurality of notched grooves.

2. The spray shield apparatus as in claim 1, wherein the resiliently biasing means is a suspended spring-leaf bridge with the corresponding tab fixedly secured thereon, the suspended spring-leaf bridge resiliently biasing when the corresponding tab is transitioned between said plurality of notched grooves.

3. The spray shield apparatus as in claim 1, wherein the means for adjustably securing further includes at least one support portion connected to the upper shank of said elongated support rod and interposed between said at least two tabs, said at least one support portion 6 having a support tip proximately positioned to said plurality of notched grooves without engaging said plurality of notched grooves, for providing radial support when the pivot end is transitioned between said various desired baffle angles.

4. The spray shield apparatus as in claim 1, wherein the tubular configuration of said pivot end has a transverse deck along said inner surface thereof, said transverse deck abutting said at least two tabs on respective inner edges thereof whereby said pivot end is retained on said upper shank of said elongated support rod.

5. The spray shield apparatus as in claim 1, wherein each mounting end is a pivot end adapted to pivot about the upper shank.

6. The spray shield apparatus as in claim 1, wherein the lower shank is adapted to be anchored into the ground adjacent said sprinkler.

* * * * *